US005966816A

United States Patent [19]

Roberson

[11] Patent Number: 5,966,816

[45] Date of Patent: Oct. 19, 1999

[54] STRAIGHT KNIFE WITH INTERCHANGEABLE PIVOTING BLADE

[76] Inventor: Robbie E. Roberson, 3330 Pearly Anthony Rd., Maryville, Tenn. 37803

[21] Appl. No.: 09/197,104

[22] Filed: Nov. 20, 1998

[51] Int. Cl.[6] ..... B26B 1/04

[52] U.S. Cl. ..... 30/156; 30/161

[58] Field of Search ..... 30/151, 153, 152, 30/155, 156, 157, 160, 161, 330

[56] References Cited

U.S. PATENT DOCUMENTS

| | | | |
|---|---|---|---|
| 234,731 | 11/1880 | Slaton | 30/161 |
| 2,343,175 | 2/1944 | Evinger . | |
| 4,442,559 | 4/1984 | Collins | 30/153 X |
| 4,606,123 | 8/1986 | Wrench . | |
| 4,651,419 | 3/1987 | Reed, Jr. . | |
| 5,093,995 | 3/1992 | Jan | 30/160 X |
| 5,661,908 | 9/1997 | Chen | 30/161 X |

*Primary Examiner*—Douglas D. Watts
*Attorney, Agent, or Firm*—Pitts & Brittian, P.C.

[57] ABSTRACT

A straight knife with an interchangeable, pivoting double-ended blade. The knife includes a handle forming a blade channel in which the unused end of the blade is stored. A pivot pin and a locking pin are provided for engaging a pair of through-openings in both the handle and the blade to allow the blade to be secured in an operative position. The pivot pin and the locking pin are connected to a gripping member by a linkage. The gripping member is provided to allow the pins to be quickly and easily removed using one hand, even when wearing bulky gloves. A locking mechanism on each of the pivot pin and the locking pin engages the handle to secure the pins in the handle. The lock pin is be removed to allow rotation of the blade around the pivot pin. Both the lock pin and the pivot pin are removed to exchange one blade for another.

12 Claims, 9 Drawing Sheets

STRAIGHT KNIFE WITH INTERCHANGEABLE PIVOTING BLADE

TECHNICAL FIELD

This invention relates to knives. More particularly, this invention relates to straight knives having interchangeable blades capable of being pivoted and exposing one of two opposing cutting ends locked in an operative position.

BACKGROUND ART

Knives are useful tools to have. A variety of knives exist for various purposes. Many types of knives are currently used, including folding knives designed for easy carrying and versatility, such as a pocket knife. Folding knives generally offer a variety of cutting or other tool ends each designed for a special purpose; however, folding knives offer this variety at the expense of the strength offered by a full tang knife. Conversely, straight knives are designed for strength and size. They are generally larger than folding knives and have a fixed blade with a full tang which provides excellent strength for rugged activities, such as for hunting. However, a major drawback of straight knives is the limitation of having only one singular-purpose blade.

A hunter in the field has many uses for a knife. For example, a hunter attempting to set up a tree stand may have need to remove small obstructing branches using a saw blade. Should the hunter successfully bring down a game animal, there is further need for specialized blades. Depending upon the size of the animal and its intended use, the hunter may require a drop point blade, a skinning blade, a filleting blade, or a gut hook blade. Such diverse blade requirements would require a hunter to have multiple straight knives on hand, and preferably accessible, to avoid digging through a pack. Further, carrying multiple knives adds unnecessary weight to the hunter's load and increases the chance of losing valuable equipment in the field.

Additionally, a hunter skinning and/or gutting a game animal may have need to change between two special purpose blades or to change to a secondary sharp blade after the first is dulled. This is a particular concern when the need to change blades occurs in the middle of the skinning or gutting process. Often the hunter will have one hand gripping a portion of the carcass to be cut and be reluctant to release that grip simply to rotate the blade. It is therefore desirable to have a knife in which the blade can be rotated with one hand.

Finally, hunters often wear bulky gloves for warmth and protection and, therefore, have need of a knife which can be easily manipulated by gloved hands.

Other multiple purpose straight knives have been previously disclosed. Typical of the art are those devices disclosed in the following U.S. Patents:

| U.S. Pat. No. | Inventor(s) | Issue Date |
|---|---|---|
| 2,343,175 | Evinger, Walter J. | Feb. 29, 1944 |
| 4,606,123 | Wrench, Robert A. | Aug. 19, 1986 |
| 4,651,419 | Reed, Jr., August D. | Mar. 24, 1987 |

U.S. Pat. No. 4,651,419 discloses a double-ended single-blade knife. The knife includes two handle sections disposed upon either side of a double-ended knife blade and held together by a pair of removable fasteners, such as screws. The first fastener passes through a pivot arm defined by the handle sections and a central through-opening of the blade while the second fastener is located rearward of the blade. A spring-lock guard sheathes the handle sections, completely enclosing the blade stored within the handle. The blade defines a pair of slots offset from the midpoint of the blade, diametrically opposed to each other, and opposite to the sharpened edge of the blade. The spring-lock guard includes a pair of internal tabs corresponding to the slots in the blade which prevent the blade from rotating.

In operation, the spring-lock guard is removed by applying pressure to an external tab to release the internal tabs from the slots of the blade and sliding the guard along the length of the handle away from the blade. Once the guard is removed, the blade is rotated and the guard replaced. However, the design of the '419 device makes one-handed rotation of the blade virtually impossible. Furthermore, the '419 is not designed for blade replacement without additional tools. Accordingly, the fasteners must be removed to permit the blade to be released from the pivot arm. This again requires two-handed operation and the availability of a removal tool, such as a screwdriver.

U.S. Pat. No. 4,606,123 discloses a cutlery apparatus with an interchangeable cutting tool. The '123 device provides a tri-fold knife system including a handle, a tool retention member, and a locking member which operate in conjunction to retain a pivoting blade. The U-shaped tool retention member defines an opening at the end of either arm where it pivotably connects to a tool by means of a pin. The handle forms a sleeve into which the tool retention member is nested. The handle and the tool are each pivotably joined to opposing ends of the tool retention member. This allows the tool retention member to pivot away from the handle such that the tool may be rotated within the tool retention member to expose either tool surface. Once a tool surface is selected, the tool retention member is pivoted into the nested operational position and the locking member is engaged to prevent the tool from rotating. The locking member is pivotably connected to the handle at the end where the tool retention member and the handle connect. The locking member includes a tab which engages a notch near the center of the tool. The tab and slot operate to secure the tool in the operating position. While the '123 device permits tools to be interchanged without the need for an external removal tool, the tri-fold mechanism does not allow easy, one-handed rotation of the tool.

U.S. Pat. No. 2,343,175 discloses a knife having two handle sections which are joined together by a permanent fastener at one end and having a first through-opening located near the end of the handle which receives a fastener that forms a pivot arm for a double-ended blade. Additionally, a second through-opening located near the midpoint of the handle receives a fastener that forms a locking arm to prevent rotation of the blade. A double-ended blade includes through-openings configured to align with the through-openings in the handle to allow the blade to pivot and to be locked into an operating position. As with the '419 device, this configuration requires two hands for changing blades and the use of a separate removal tool, such as a screwdriver. The '175 does not include spacers between the handle sections. With a compressive fastener, such as a screw, the handle sections may be pulled together thereby creating sufficient friction to prevent the easy rotation of the blade even when the locking arm is removed.

Accordingly, there is a need for a straight knife which has blades which may be rapidly interchanged without the need for a removal tool. Additionally, there is a need for a straight knife which accommodates a double-ended blade which may be rapidly pivoted to present either cutting surface for use. Furthermore, there is a need for a straight knife which has a blade which can be easily manipulated with one hand, particularly where that hand is gloved.

It is therefore an object of the present invention to provide a straight knife having a double-ended blade member which can be pivoted to present either end in an operative position.

Another object of the present invention is to provide a straight knife configured for receiving a variety of interchangeable blade members.

Yet another object of the present invention is to provide a straight knife which permits the blade member to be pivoted or exchanged without the need for an additional removal tool.

A further object of the present invention is to provide a straight knife which permits the blade member to be pivoted and locked into operating position using only one hand.

DISCLOSURE OF THE INVENTION

A straight knife with an interchangeable, pivoting blade for providing rapid, one-handed access to either end of a double-ended blade is provided. The straight knife provides interchangeable, double- end blade members. Either end of the blade member can be locked in an operative position and the blade member can be exchanged with another without the need for a removal tool.

The knife includes a handle member and a blade member. The blade member is disposed with a blade channel defined by the handle member and secured therein by a key member. The key member includes a pivot pin and a lock pin. The pivot pin and the lock pin are configured to be removed either by individual gripping members or a single gripping member attached to a linkage connecting the pivot pin and the link pin. The gripping member includes a contoured bottom surface to provide clearance for a users finger between the gripping member and the handle member allowing the pins to be quickly and easily removed by one hand, even when wearing bulky gloves.

Each of the handle member and the blade member defines a pivot opening and a lock opening for receiving the pivot pin and the lock pin. Each of the pivot pin and the lock pin include a locking mechanism which engages the handle member to retain each pin in their respective openings. The locking mechanism is designed for simple operation and quick release of the pins using one hand.

The pivot pin and the lock pin secure the blade member within the blade channel of the handle member. With both pins inserted, the blade member is locked in an operative position presenting one end of the blade for use. Each pin can be removed individually. Removing the lock pin allows the blade member to rotate around the pivot pin to present the opposing end in an operative position. Removing both the lock pin and the pivot pin permits the current blade member to be exchanged for another.

BRIEF DESCRIPTION OF THE DRAWINGS

The above-mentioned features of the invention will become more clearly understood from the following detailed description of the invention read together with the drawings in which.

BEST MODE FOR CARRYING OUT THE INVENTION

A straight knife with an interchangeable, pivoting blade, or knife, for providing rapid, one-handed access to either end of a double-ended blade is illustrated generally at 10 in the figures. The knife is provided with a handle forming a blade channel in which the unused end of the blade is stored. A pivot pin and a locking pin are provided for engaging a pair of through-openings in both the handle and the blade to allow the blade to be secured in an operative position. The pivot pin and the locking pin are connected to a gripping member by a linkage. The gripping member is provided to allow the pins to be quickly and easily removed by one hand, even when wearing bulky gloves.

Figure 1:
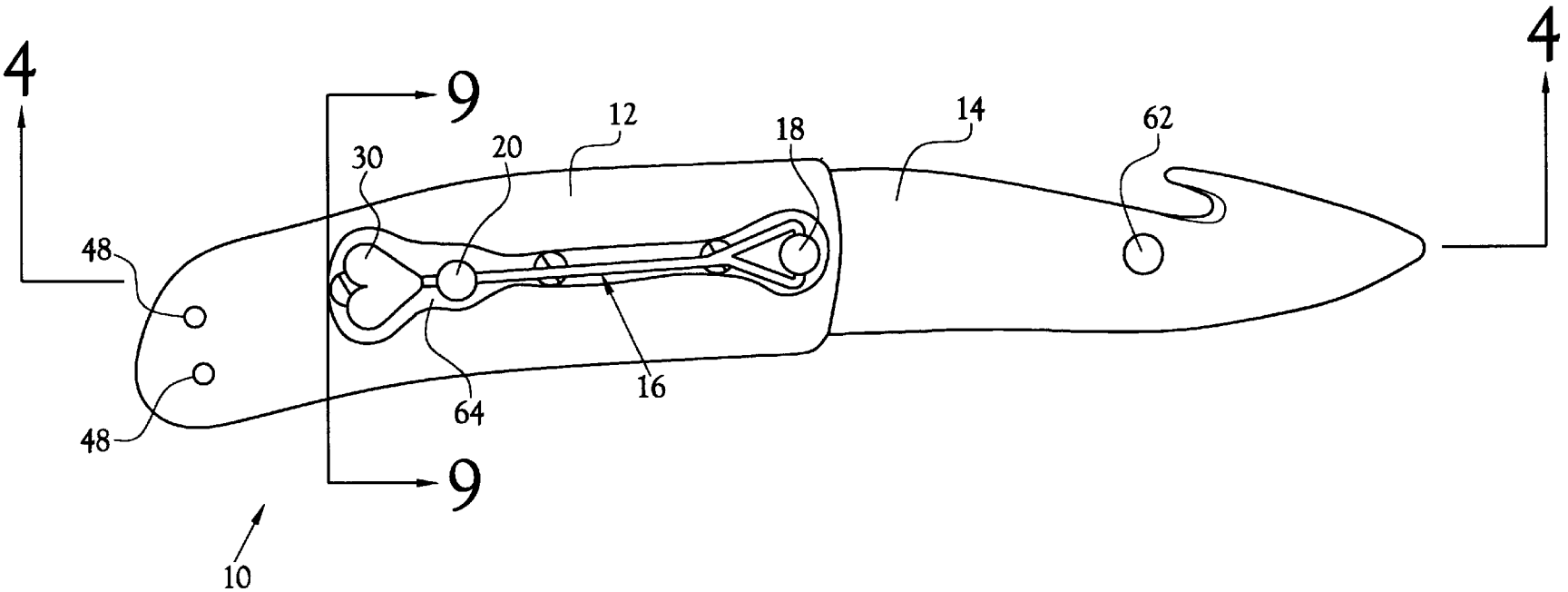
FIG. 1 illustrates a top plan view of a straight knife with pivoting blade incorporating various features of the present invention.

FIG. 1 illustrates a top view of the knife 10. The knife 10 includes a handle member 12 and a double-ended blade member 14. The blade member 14 is disposed within a blade channel 40 defined by the handle member 12 and secured therein by a linking member 16 disposed within the linkage channel 64 and having a manipulable gripping member 30. The linking member 16 includes a pivot pin 18 around which the blade member 14 rotates and a lock pin 20 for securing the blade member 14 in an operative position.

Figures 2A, 2B, 2C:
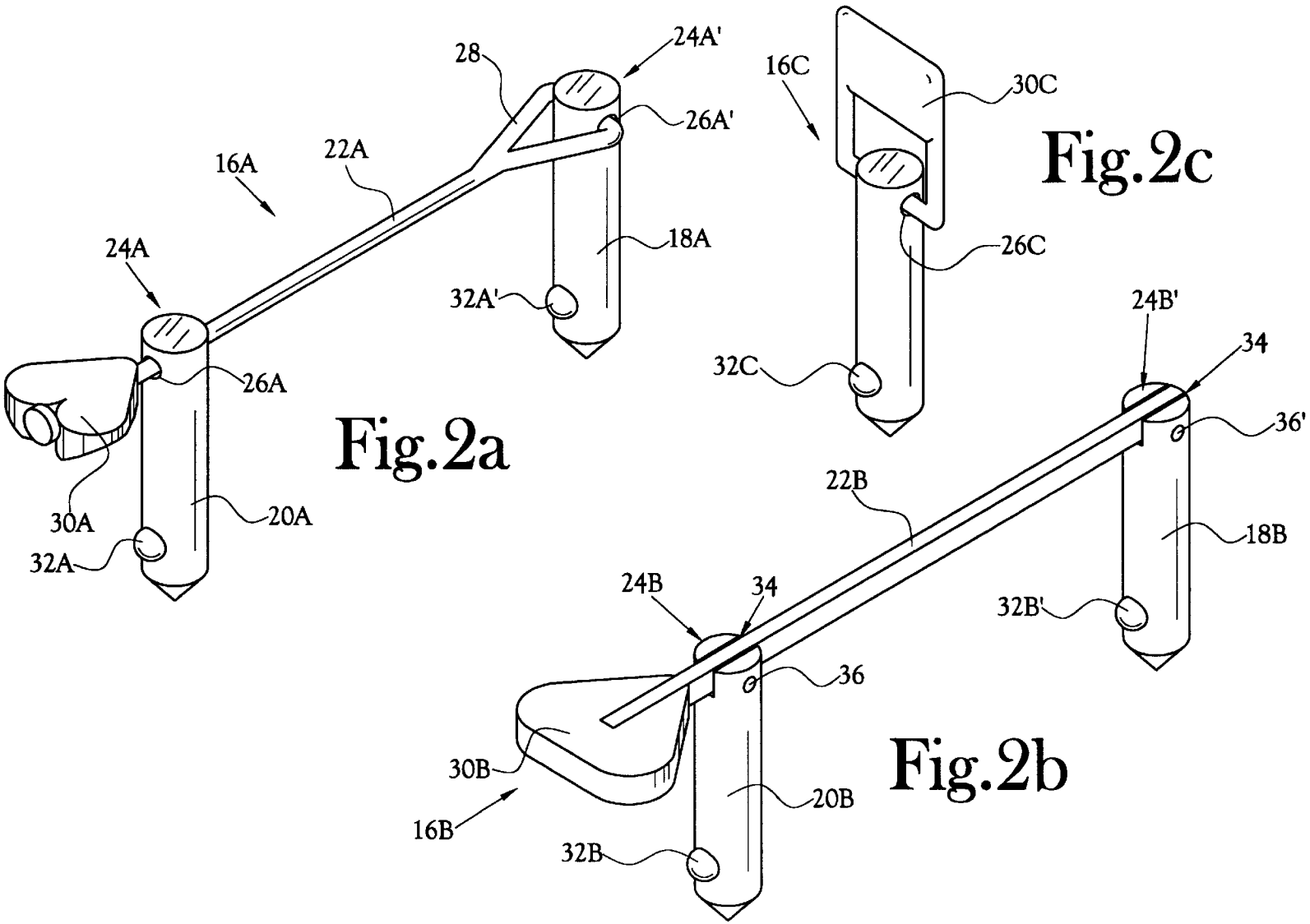
FIGS. 2*a* to 2*c* illustrate perspective views of alternate embodiments of the key member of the straight knife of the present invention incorporating various features of the present inventions.

FIGS. 2*a* through 2*c* illustrate alternate embodiments of the linking member 16. FIG. 2*a* illustrates a first embodiment of the linking member 16A. The linking member 16A includes a pivot pin 18A connected to a lock pin 20A by a linkage 22A. In the illustrated embodiment, the linkage 22A is an elongated member having a circular cross section. One skilled in the art will recognize that the linkage 22A may have other cross-sectional shapes without interfering with the objects of the present invention. Defined proximate to a first end 24A, 24A' of each of the pivot pin 18A and the lock pin 20A is a through-opening 26A, 26A' which receives the linkage 22A. In the illustrated embodiment, the pivot pin 18A is fixedly secured to a first end 28 of the linkage 22A. The first end 28 defines a yoke which is closed to secure the pivot pin 18A to the linkage 22A. One skilled in the art will recognize that various methods can be used to close the yoke 28, such as compression, soldering, and welding. The lock pin 20A is movably secured to the linkage 22A between the yoke 28 and a second end defining a gripping member 30A. In the illustrated embodiment, the gripping member 30A is heart-shaped gripping member fixedly connected to the linkage 22A by any conventional means including soldering, welding, and the use of a fastener. One skilled in the art will recognize that the gripping member 30A may be configured with a variety of shapes without interfering with the objects of the present invention. Further, one skilled in the art will recognize that the gripping member may be integrally formed with the linkage without interfering with the objects of the present invention. Further, each of the pivot pin 18A and the lock pin 20A includes a locking mechanism 32A, 32A'. In the illustrated embodiment, the locking mechanism 32A, 32A' is a spring-biased ball bearing. One skilled in the art will recognize that other locking mechanisms could be used.

Referring now to FIG. 2*b,* an alternate embodiment of the linking member 16B is shown. As before, the linking member 16B includes a pivot pin 18B connected to a lock pin 20B by the linkage 22B. In the illustrated embodiment, the linkage 22B is an elongated member having a rectangular cross section. Each of the pivot pin first end 24B' and the lock pin first end 24B define a slot 34, 34'which receives the linkage 22B. The linkage 22B is retained in the slot 34, 34' by a transversely mounted fastener 36, 36'. The second end of the linkage 22B forms a gripping member 30B.

Finally, FIG. 2*c* illustrates another embodiment of the linking member. Each of the pivot pin 18 and the lock pin 20 are independent and each includes a through-opening 26C which receives a gripping member 30C, thereby allowing each of the pivot pin 18 and the lock pin 20 to be removed independently of the other.

Figure 3:
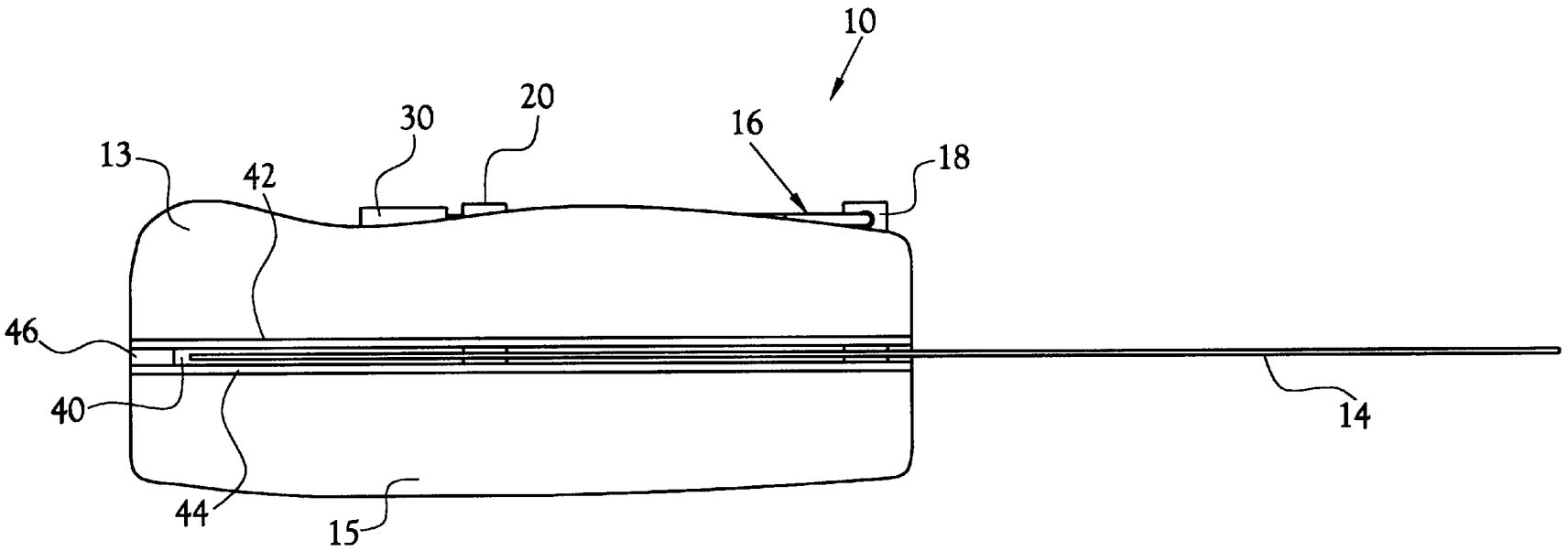
FIG. 3 illustrates a side elevation view of the straight knife with a pivoting blade incorporating various features of the present invention.

FIG. 3 illustrates a side view of the knife 10. In the illustrated embodiment, the handle member 12 includes a first handle section 13 having a first liner 42 and a second handle section 15 having a second liner 44 separated by a spacer 46 disposed at one end of the handle member 12 to define the blade channel 40 therebetween. One skilled in the art will recognize that the handle member 12 could be formed as a single piece thereby defining the blade channel 40 directly without interfering with the objects of the present invention. The first liner 42, the second liner 44, and the spacer 46 are secured to the handle member 12 by at least one handle fastener 48, as illustrated in FIG. 1. In the illustrated embodiment, each handle fastener 48 is a rivet. Returning now to FIG. 3, the blade member 14 is disposed within the blade channel 40. Further, in the illustrated embodiment, the linkage 16 is substantially flush with the surface of the handle member 12 minimizing the inconvenience imposed by the linkage 16 on the contour of the handle member 12 which is designed for handling comfort. The interconnection of these components is illustrated in greater detail in FIG. 4.

Figure 4:
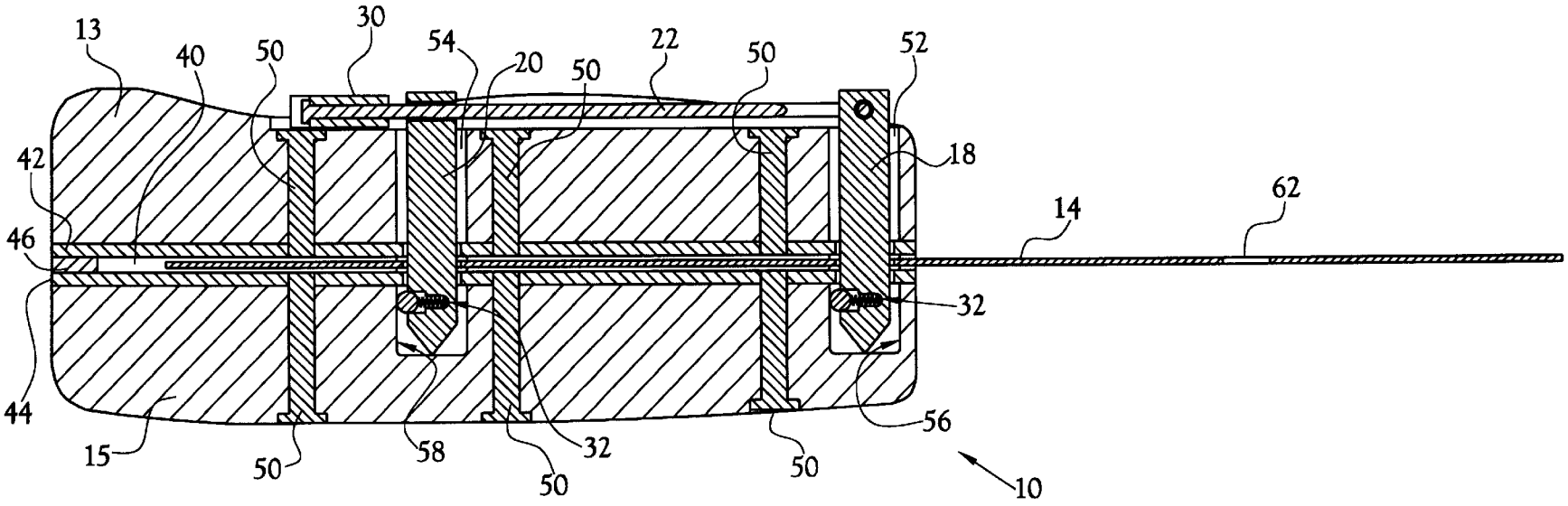
FIG. 4 illustrates a side elevation view of the straight knife with a pivoting blade, taken at section 4—4 of FIG. 1, incorporating various features of the present invention.

FIG. 4 illustrates a side view of the knife 10 in section. In the illustrated embodiment, the first liner 42 is secured to the first handle section 13 by at least one liner fasteners 50. Similarly, at least one additional liner fastener 50 secures the second liner 44 to the second handle section 15. In the illustrated embodiment, the liner fasteners 50 are selected to be removable to allow disassembly of the knife 10 as needed. One skilled in the art will recognize that other fasteners could be used without interfering with the objects of the present invention. The first handle section 13 defines a pivot through-opening 52 proximate the end of the handle member 12 opposing the spacer 46 and a lock through-opening 54 along the length of the handle member 12. Corresponding openings are provided in both the blade member 14 and each of the first liner 42 and the second liner 44. Similarly, the second handle section 15 defines a pivot opening 56 and a lock opening 58 corresponding to the respective through-openings 52, 54 on the first handle section 13. The blade member 14 is secured within the blade channel 40 by the pivot pin 18 and the lock pin 20 which are received by the pivot through-opening 52 and the lock through-opening 54, respectively. Each pin 18, 20 is retained in its respective opening 52, 54, 56, 58 by the locking mechanism 32. The locking mechanism 32 is designed for simple operation and quick release of the pins 18, 20. In the illustrated embodiment, the locking mechanism 32 is spring-biased ball-bearing which engages the bottom edge of the second liner 44 to form a lock. Similarly, the first liner 42 and second liners 44 could be combined with the spacer 46 to form a single liner member. Finally, one skilled in the art will recognize that the second handle section pivot opening 56 and the second handle section lock opening 58 may be through-bores without interfering with the objects of the present invention.

Figure 5:
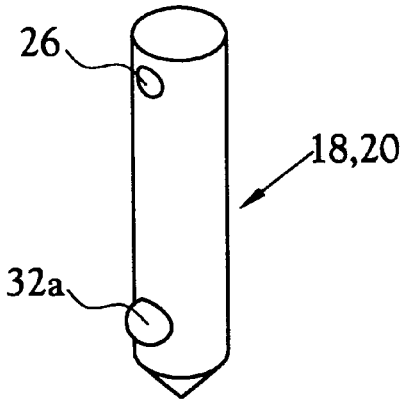
FIG. 5 illustrates one embodiment of the locking mechanism for retaining the blades in the straight knife with pivoting blade of the present invention.
Figure 6:
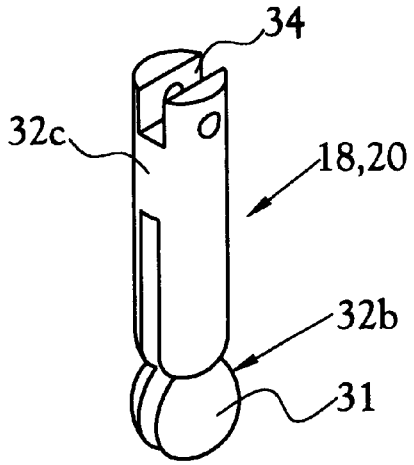
FIG. 6 illustrates another embodiment of the locking mechanism for retaining the blades in the straight knife with pivoting blade of the present invention.
Figure 7:
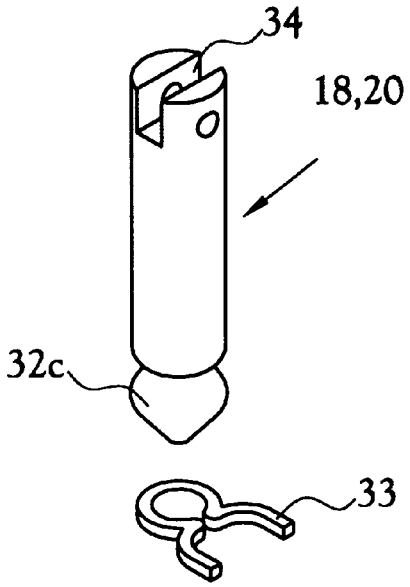
FIG. 7 illustrates still another embodiment of the locking mechanism for retaining the blades in the straight knife with pivoting blade of the present invention.
Figure 8:
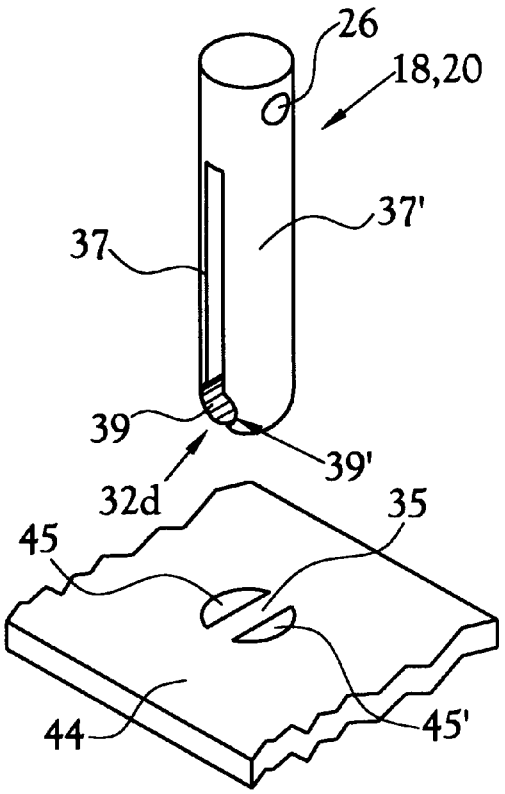
FIG. 8 illustrates yet another embodiment of the locking mechanism for retaining the blades in the straight knife with pivoting blade of the present invention.

FIGS. 5 through 8 illustrate alternate embodiments of the locking mechanism 32 for the pivot pin 18 and the lock pin 20. Generally, the locking mechanism 32 engages a lip on either the handle member 12 or the liner member 44 to retain each pin 18, 20 in the corresponding through-opening. FIG. 5 illustrates a pin 18, 20 having at least one spring-biased, ball-bearing locking mechanism 32A. FIG. 6 illustrates a pin 18, 20 having a split-pin locking mechanism 32B which compresses during insertion and removal. The contoured head 11 expands, once properly seated, such that the narrow neck of the pin 18, 20 engages a lip of the handle member 12 or liner member 44. FIG. 7 illustrates locking clip 33 for use with a pin 18, 20 having a contoured-neck locking mechanism 32C. The locking clip 33 is a spring-biased clip fixedly connected to the handle 12 or one of the liners 42, 44. When inserted or removed, the slope of the contoured-neck locking mechanism 32D gradually spreads the locking clip 33 to allow the pin 18, 20 entrance or egress. Once inserted past the slope, locking clip 33 closes around the narrow neck, thereby retaining the pin 18, 20. FIG. 8 illustrates a pin 18, 20 having clamp-design locking mechanism 32*e* for gripping a tab 35 defined by the second liner 44. The clamp-design locking mechanism 32*d* includes a pair of clamp arms 37, 37' each defining a detent 39, 39'. The second liner 44 defines a pair of semicircular through-openings 45, 45' which are configured to receive the clamp arms 37, 37' whereupon the pair of detents encloses the tab 35 thereby retaining the pin 18, 20.

Figure 9:
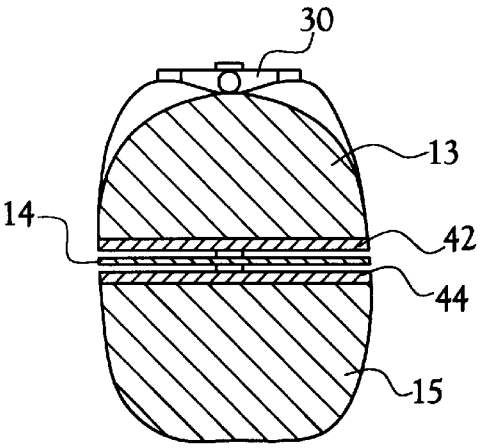
FIG. 9 illustrates a rear elevation view of the straight knife with a pivoting blade, taken at section 10—10 of FIG. 1, incorporating various features of the present invention.

FIG. 9 illustrates a sectional rear elevation view of the knife 10 with the gripping member 30 exposed. In the illustrated embodiment, the gripping member includes a contoured bottom surface 31 providing greater finger room between the gripping member 30 and the handle member 12 thereby making the gripping member 30 easier to release. One skilled in the art will recognize that other shapes, widths, and angles can be used to increase the area between the gripping member 30 and the handle member 12 without interfering with the objects and advantages provided by the knife 10.

Figure 10:
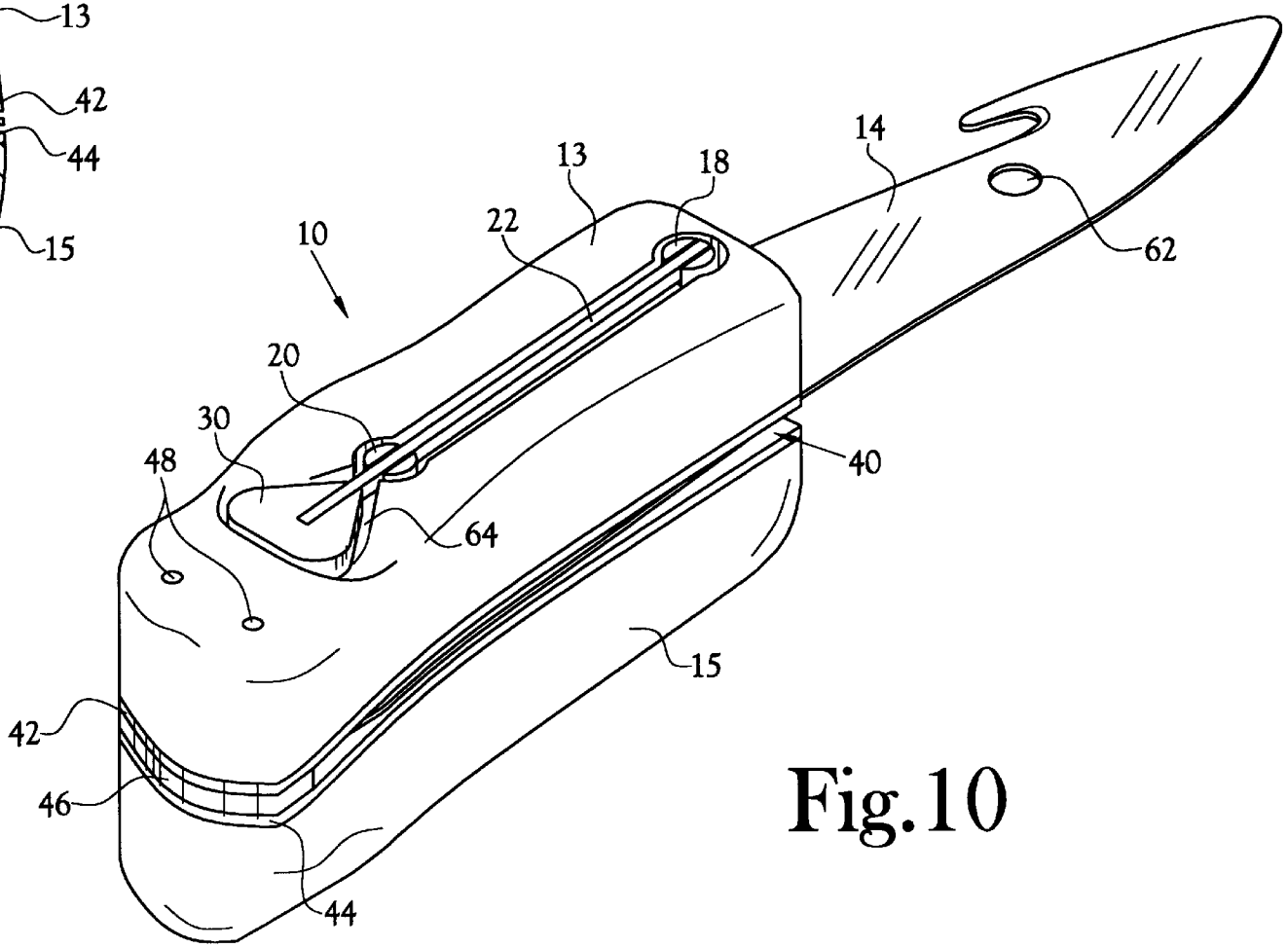
FIG. 10 illustrates a perspective view of the straight knife with pivoting blade of the present invention with the blade member locked in an operative position.

FIG. 10 illustrates the knife 10 with the blade member 14 locked in an operative position. The blade member 14 placed in blade channel 40 with the pivot holes and the lock holes of the handle member 12 and the blade member 14 being axially aligned. The pivot pin 18 and the lock pin 20 are inserted into their respective openings until the locking mechanism 32 of each pin 18, 20 engages.

Figure 11:
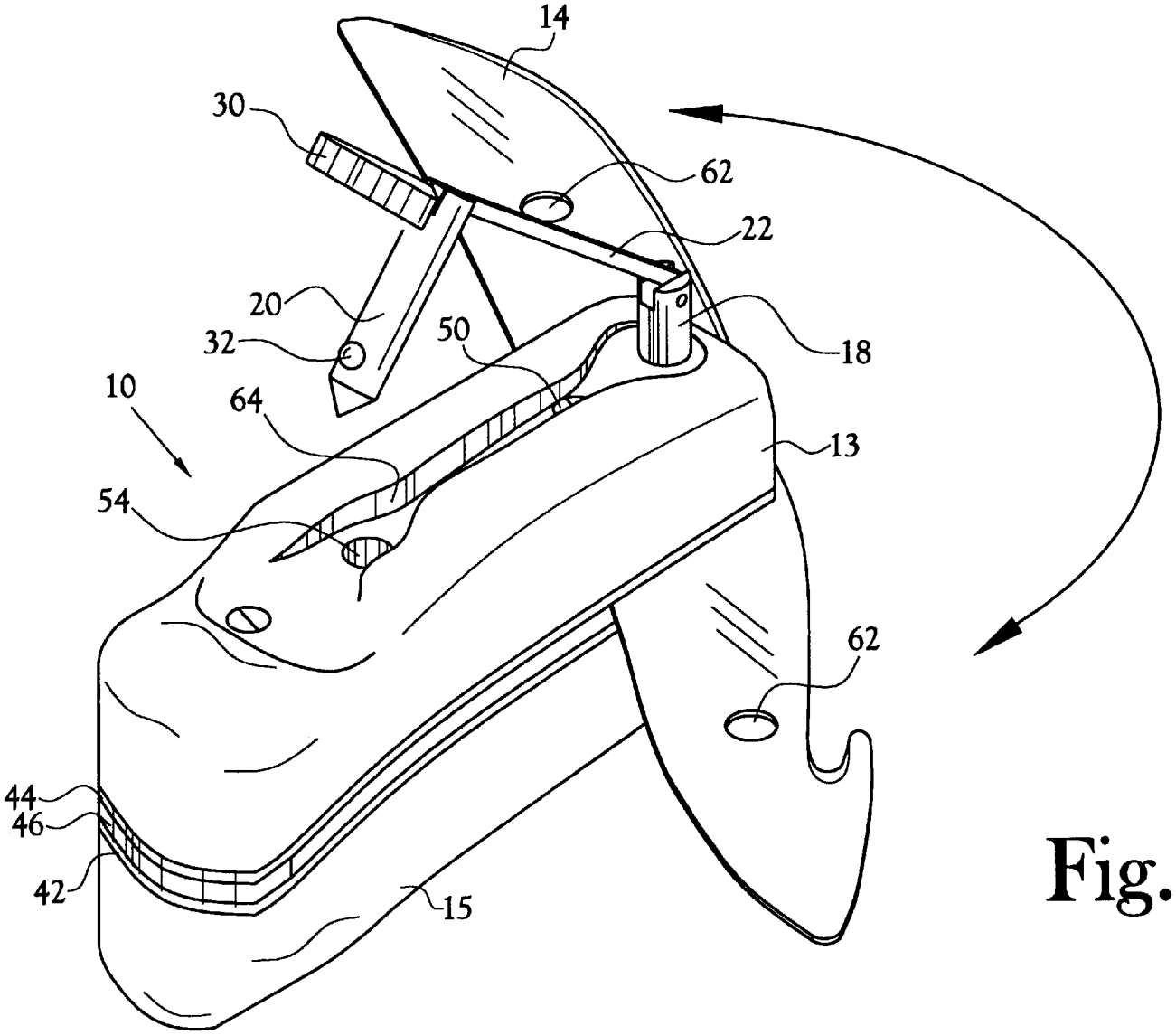
FIG. 11 illustrates a perspective view of the straight knife with pivoting blade of the present invention with the lock pin disengaged such that the blade member is free to pivot around the pivot pin.

FIG. 11 illustrates the knife 10 with the lock pin 20 removed, allowing the blade member 14 to rotate freely around the pivot pin 18. The knife is supported using one hand with the thumb manipulating the gripping member 30 to disengage the locking mechanism 32 from the handle member 12 and remove the lock pin 20. The blade member is then rotated around pivot pin 18 to present the selected end of the blade member. The lock pin 20 is then reseated within the handle member by manipulating the gripping member 30 with the thumb. One skilled in the art will recognize that while a one-handed pivoting operation is described, two hands may be used to accomplish this operation.

Figure 12:
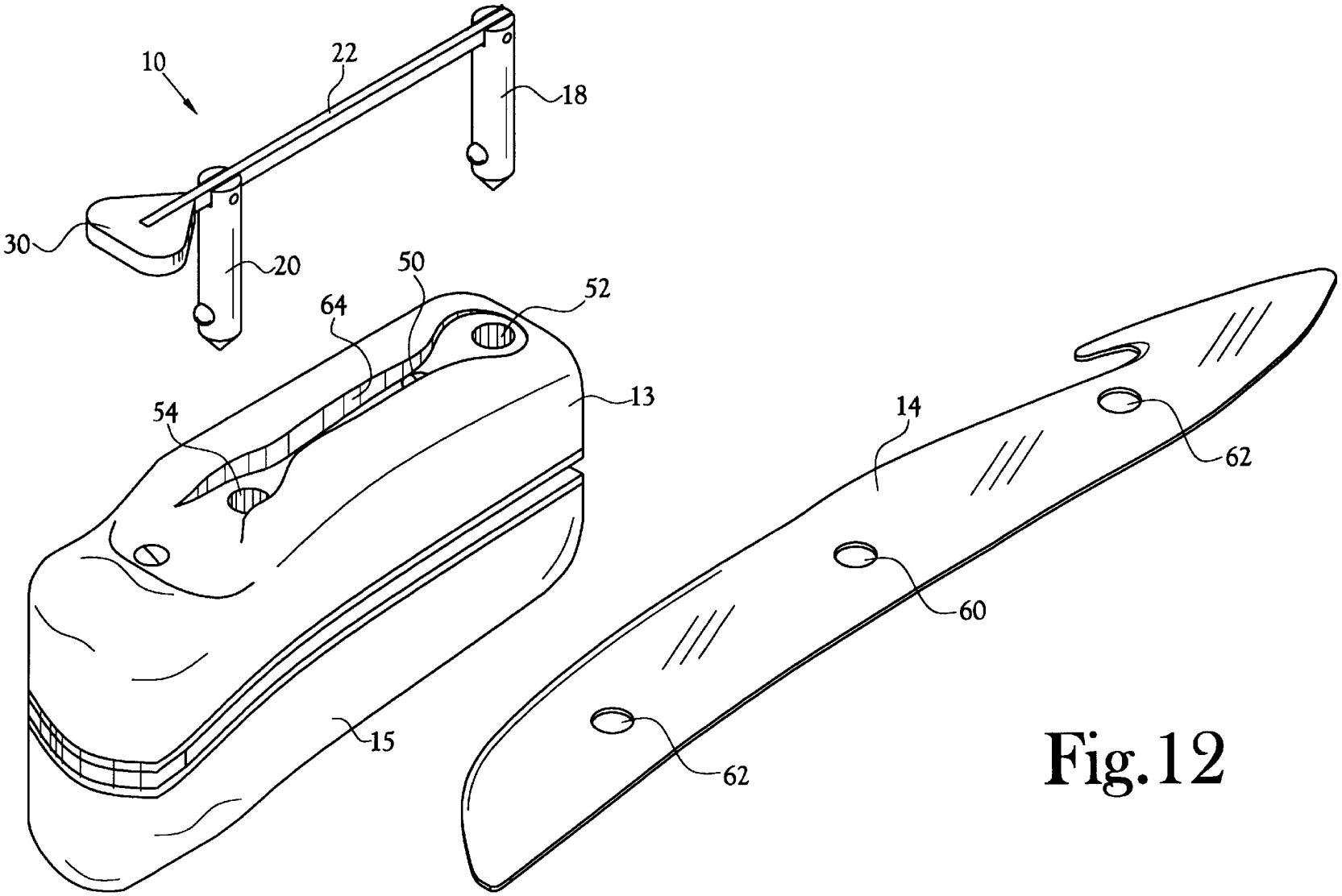
FIG. 12 illustrates a perspective view of the straight knife with pivoting blade of the present invention with both the lock pin and the pivot pin disengaged and the blade member removed.

FIG. 12 illustrates the knife 10 with the lock pin 20 and the pivot pin 18 removed, allowing the blade member 14 to be interchanged with another. The lock pin 20 and the pivot pin 18 are removed by manipulating the gripping member 30 to disengage each locking mechanism 32 from the handle member 12. The blade member 14 is then removed from the blade channel 40. A new blade member 14 may then be inserted into the blade channel 40 until the lock openings and the pivot openings of the handle member 12 and the blade member 14 are axially aligned. The pivot pin 18 and the lock pin 20 are then reinserted into their respective openings until each lock mechanism 32 engages the handle member 12, thereby securing each pin 18, 20. Clearly visible with the linking member 16 removed is the linkage channel 64 defined by the handle member 12 where the linkage 22 rests when the pivot pin 18 and the lock pin 20 are inserted into the knife 10. The linkage channel allows the handle member to retain a contoured shape which is comfortable to grip when the knife 10 is in use.

Figure 13A:
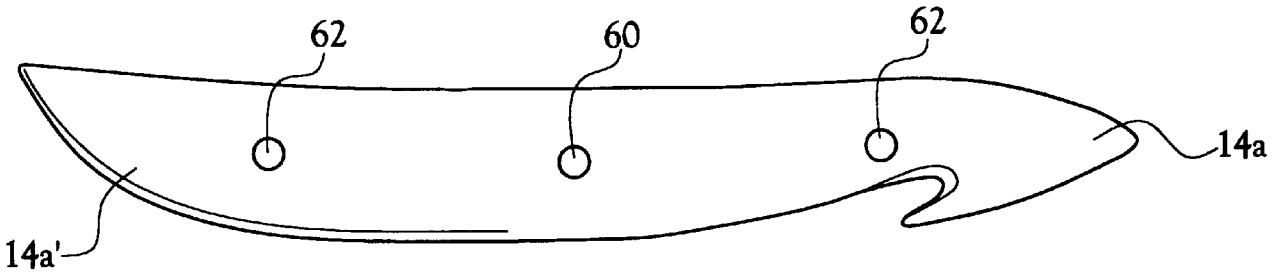
FIGS. 13*a* to 13*c* illustrate alternate embodiments of blade members for use with the straight knife with pivoting blade of the present invention.
Figure 13B:
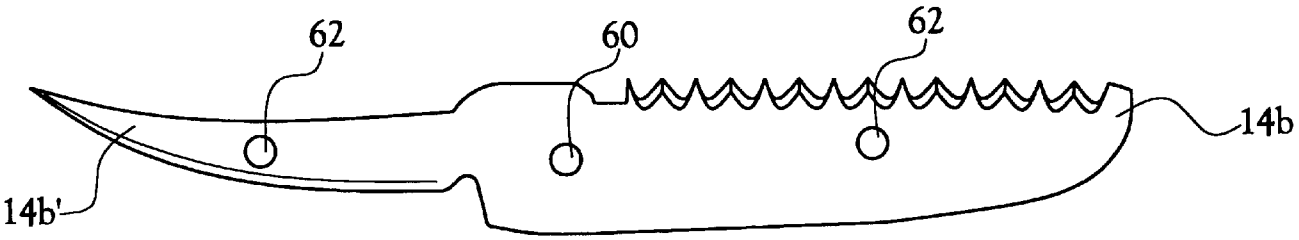
Figure 13C:
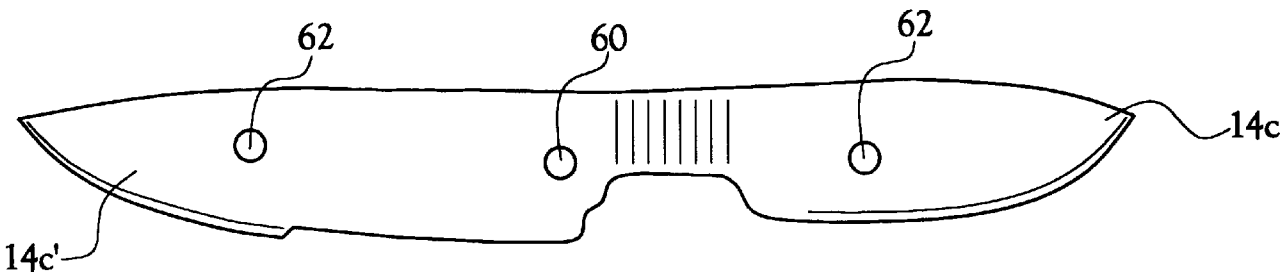

FIGS. 13*a* through 13*c* illustrate various double-ended blade members 14 having special purposes for use with the knife 10. For example, illustrated are a gut-hook blade 14A, a skinning blade 14A', a saw blade 14B, a filleting blade 14B', a scalpel blade 14C, and a drop-point blade 14C'. Further, each blade member 14 defines a central through-opening 60 which aligns with the pivot through-opening 52 and a pair of end through-openings 62 which are equidistant from the central through-opening 60 and positioned to align with lock through-opening 54 of the handle member 12.

Accordingly, it will be recognized by one skilled in the art that a straight knife is provided meeting the objects of the present invention. The straight knife provides interchangeable double-end blade members. Either end of the blade member can be locked in an operative position and the blade member can be exchanged with another without the need for a removal tool. The blade member is secured within the handle member by a pivot pin and a lock pin which are configured to allow the operative end of the blade member to be rotated with one hand. While the knife is held in one hand, the lock pin can be manipulated by the same hand to release the end of the blade member, allowing the blade member to be pivoted using the same hand into the opposite operative position, and then the lock pin can be replace still using the same hand.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A knife comprising:

a handle member defining a blade channel, said handle member having a first end and a second end, said handle member defining a pivot opening in said handle member second end and at least one lock opening;

a blade member configured to be received within said blade channel, said blade member defining a pivot through-opening disposed centrally on said blade member to cooperate with said handle member pivot opening, said blade member further defining at least a first lock through-opening between said blade member pivot through-opening and a first end of said blade member to cooperate with said handle member lock opening when said blade member is oriented in a first operative position and a second lock through-opening between said blade member pivot through-opening and a second end of said blade member to cooperate with said handle member lock opening when said blade member is oriented in a first operative position;

a pivot pin being releasably received by said handle member pivot opening and said blade member pivot through-opening, said pivot pin including a locking device for retaining said pivot pin within said handle member pivot opening and said blade member pivot through-opening; and a lock pin being releasably received by said handle member lock through-opening and one of said first and second blade member lock through-openings, said lock pin including a locking device for retaining said lock pin within said handle member lock opening and said one of said first and second blade member lock through-openings, said lock pin being removable from said lock opening to permit said blade member to pivot around said pivot pin.

2. The knife of claim 1 wherein said handle member includes a first handle section and a second handle section fixedly connected at said first end of said handle member and defining said blade channel therebetween.

3. The knife of claim 2 wherein each of said pivot opening and said lock opening is defined by a first through-opening defined by said first handle section and a second opening defined by said second handle section and opening into said blade channel.

4. The knife of claim 1 wherein said handle member includes a liner conventionally connected to said handle member proximate said blade channel.

5. The knife of claim 1 wherein said locking device is a spring-biased ball-bearing which engages a lip of at least one of said handle member and a lip of said liner.

6. The knife of claim 1 further comprising a linkage member having a first end and a second end, said pivot pin being carried by said linkage member first end and said lock pin being carried by said linkage member between said linkage member first end and said linkage member second end such that said lock pin may be received by said lock opening when said pivot pin is received by said pivot opening.

7. The knife of claim 6 wherein said pivot pin is pivotably connected to said linkage member and said lock pin is pivotably connected to said linkage member.

8. The knife of claim 6 wherein said linkage member second end forms a gripping member, said gripping member having a contoured bottom surface to provide clearance between said gripping member and said handle member for receiving a user's finger to manipulate said gripping member away from said handle member.

9. The knife of claim 6 wherein said handle defines a linkage channel for receiving said linkage member such that said linkage member is substantially flush with an outer surface of said handle member.

10. The knife of claim 1 wherein said pivot pin is removable from said pivot opening to permit said blade member to be removed from said blade channel when said lock pin is removed from said lock opening.

11. The knife of claim 1 wherein said handle member is configured such that said handle member is gripped, said lock pin is released, said blade member is pivoted around said pivot pin, and said lock pin is replaced using one hand.

12. The knife of claim 1 wherein said handle member lock opening is defined between said handle member first end and said handle member second end.

* * * * *